US006868754B2

(12) United States Patent
Eix

(10) Patent No.: US 6,868,754 B2
(45) Date of Patent: Mar. 22, 2005

(54) APPARATUS FOR ROTATING OBJECTS AROUND A BASE OF A TREE AND A METHOD FOR MAKING THE APPARATUS

(76) Inventor: Cris Annette Eix, 313 W. Ave. de los Lobos Marinos, San Clemente, CA (US) 92672

( * ) Notice: Subject to any disclaimer, the term of this patent is extended or adjusted under 35 U.S.C. 154(b) by 88 days.

(21) Appl. No.: 10/155,772

(22) Filed: May 26, 2002

(65) Prior Publication Data

US 2003/0217618 A1 Nov. 27, 2003

(51) Int. Cl.[7] ..... F16M 13/00
(52) U.S. Cl. ..... 74/572; 248/347.1; 108/22
(58) Field of Search ..... 74/572, DIG. 9; 248/521, 522, 347.1; 104/35, 43; 108/20, 22; 312/249.2, 305

(56) References Cited

U.S. PATENT DOCUMENTS 2,469,884 A * 5/1949 Masone ..... 248/521
2,847,175 A * 8/1958 Farley et al. ..... 47/40.5
2,874,496 A * 2/1959 Rakes ..... 40/457
3,495,083 A * 2/1970 Spoerl ..... 40/431
4,191,437 A * 3/1980 Funke ..... 312/305
4,237,796 A * 12/1980 Gordon et al. ..... 108/22
4,269,122 A * 5/1981 Crimaldi ..... 104/167
4,716,837 A * 1/1988 Valencia ..... 104/38
5,149,043 A * 9/1992 Grundmann ..... 248/349.1
5,647,569 A * 7/1997 Sofy ..... 248/522
5,878,555 A * 3/1999 Turfan et al. ..... 53/588
5,878,989 A * 3/1999 Allman ..... 248/522

* cited by examiner

*Primary Examiner*—David A. Bucci
*Assistant Examiner*—Vicky A. Johnson

(57) ABSTRACT

An apparatus for rotating objects around a tree. The apparatus includes a rigid material that has a top surface and a bottom surface with a first aperture, configured to receive the base of the tree. The aperture is disposed substantially in the center of the rigid material. A gear is coupled to the bottom surface of the rigid material. A frame includes a pinion configured to rotate about the gear. A motor, coupled to the pinion, rotates the pinion. The frame also includes a second aperture, configured to receive the base of a tree.

3 Claims, 7 Drawing Sheets

APPARATUS FOR ROTATING OBJECTS AROUND A BASE OF A TREE AND A METHOD FOR MAKING THE APPARATUS

BACKGROUND

1. Field of the Invention

The present invention relates generally to an apparatus for rotating a rigid material such as a board, configured to support objects, above a frame. More specifically, the invention relates to rotating a rigid material that supports objects such as presents or gifts around a tree.

2. Background

Christmas is one of the most important holidays celebrated throughout the world. To celebrate Christmas, families may purchase an evergreen tree or an artificial tree and place the tree in an area of their home. Presents are typically placed directly on the floor or on a cloth-like material around the base of the Christmas tree. One disadvantage to this approach is that the presents that may surround the tree may not be easily accessible by a person. This causes a variety of problems. To retrieve the presents, a person may inadvertently contact the tree thereby knocking down and breaking ornaments that were placed on the tree. Another potential problem is that the person may be hurt by one of the branches from the tree while retrieving a gift. It is therefore desirable to develop a device that addresses these problems.

BRIEF DESCRIPTION OF THE DRAWINGS

The present invention is illustrated by way of example and is not limited in the figures of the accompanying drawings, in which like references indicate similar elements and in which.

DETAILED DESCRIPTION

An apparatus is disclosed that includes a rigid material, coupled to a frame, for rotating objects around a tree. In one embodiment, the apparatus includes the rigid material that has a top surface and a bottom surface with an aperture configured to receive the base of the tree. The aperture is disposed substantially in the center of the rigid material. A gear is coupled to the bottom surface of the rigid material.

A frame, coupled to the rigid material, is disposed parallel to the rigid material and serves to support the rigid material. The frame includes a pinion configured to rotate about the gear coupled to the rigid material. A motor, coupled to the pinion, causes the pinion to rotate. This in turn causes the rigid material to rotate by the gear contacting and rotating about the pinion. The frame is configured to allow the base of the tree to extend therethrough. In one embodiment, the frame is smaller in diameter than the rigid material.

In the following description, numerous specific details are set forth to provide a thorough understanding of the invention. However, it will be understood by one of ordinary skill in the art that the invention may be practiced without these specific details. In other instances, well known structures and techniques have not been shown in detail to avoid obscuring the invention.

Figure 1:
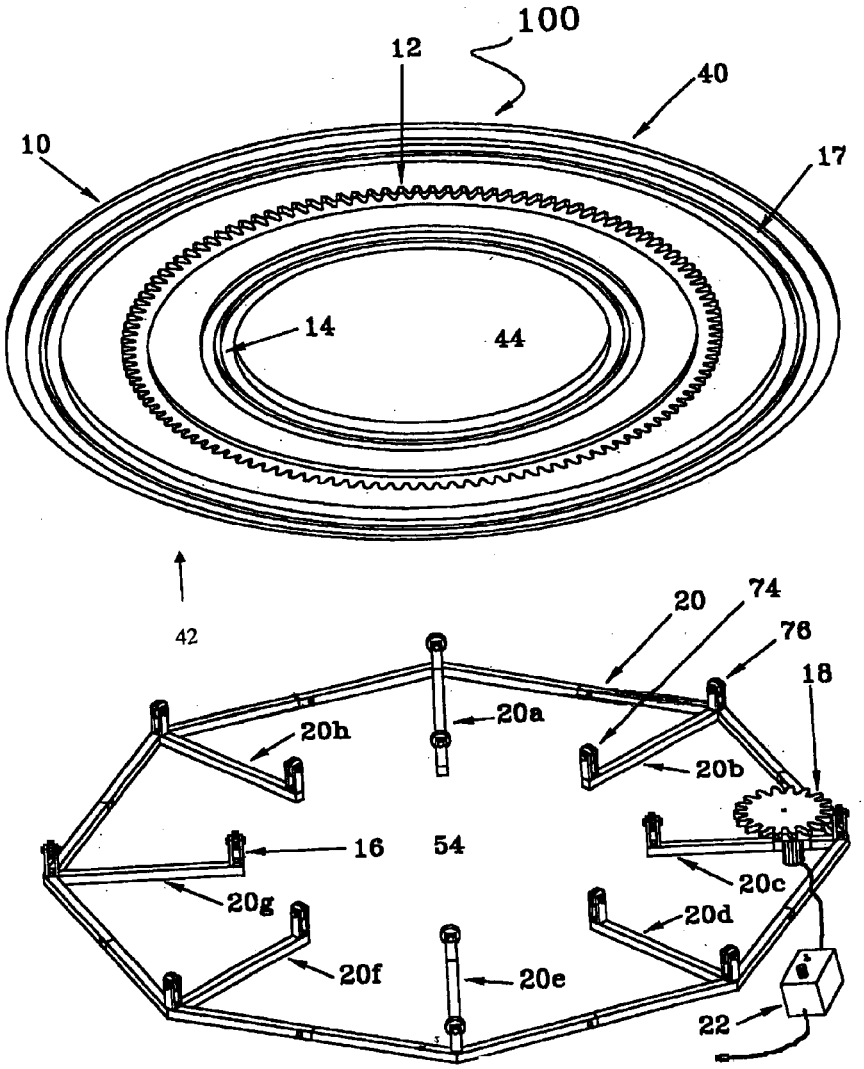
FIG. 1 is a block diagram of one embodiment of an apparatus for rotating objects around a tree.

FIG. 1 is a block diagram of one embodiment of an apparatus for rotating objects around a tree. Apparatus 100 includes rigid material 10 configured to receive objects such as presents or gifts and frame 20 that is coupled to rigid material 10 and serves to support rigid material 10. Rigid material 11 and frame 20 are now described in greater detail below followed by a description as to the manner in which rigid material 10 is rotated relative to frame 20.

Rigid material 10 has top surface 40 for receiving objects such as presents and bottom surface 42 that is parallel to and faces frame 20. Aperture 44 located in about the center of rigid material 10 is configured to receive a base of an artificial or real Christmas tree.

Although rigid material 10 is shown in FIG. 1 to have a substantially circular shape, rigid material 10 may have a variety of shapes such as substantially square, rectangular, triangular, cone-shaped or other suitable shapes. In one embodiment, rigid material 10 is substantially flat along, for example, the diameter of a circular rigid material 10. Substantially flat includes rigid material that may have a 0 to 10 degree angle from the center to one end of rigid material 10.

Figure 2:
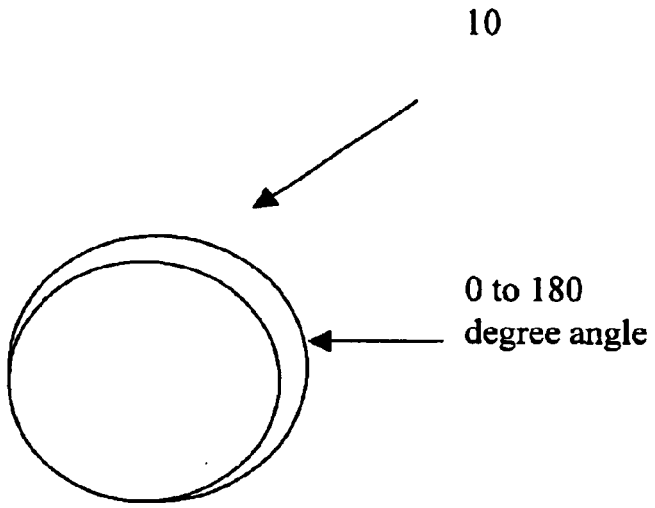
FIG. 2 is a block diagram of one embodiment of a rigid material.

In another embodiment shown in FIG. 2, rigid material 10 is substantially curved at the outer diameter compared to the center of a circular rigid material 10 to prevent objects from falling off of rigid material 10 due to, for example, the speed of rotating rigid material 10 or the placement of the objects. This curve may range from about 1 to 170 degrees.

Referring to FIG. 1, bottom surface 42 of rigid material 10 includes first and second grooves (14, 17). First and second grooves (14, 17) are configured to receive a first and second set of wheels (74, 76) coupled to frame 20. The depth and the width of the grooves is dependent upon the size of wheels, marbles or other like objects that are inserted into the grooves.

In one embodiment, first groove 14 is located about one tenth to about three-quarters from the center of aperture 44 and is diametrically opposed to first set of wheels 74. Second groove 17 is located at about the outer diameter of rigid material 10 and is diametrically opposed to second set of wheels 74. Gear 12, used to rotate rigid material 10 by contacting pinion 18 disposed on frame 20, is coupled to rigid material 10 using conventional means. Gear 12 is configured to contact and rotate about pinion 18 coupled to frame 20. In one embodiment, pinion 18 is coupled to motor 22. Motor 22, optionally located externally to frame 20 or between frame 20 and rigid material 10, drives pinion 18. Pinion 18, which contacts gear 12, causes gear 12 to rotate thereby rotating rigid material 10. In another embodiment, a person may manually rotate rigid material 10 without the use of motor 22 by pushing (or pulling) rigid material 10 in one direction.

Although FIG. 1 shows one embodiment of frame 20 with connecting arms 20A–20H, another embodiment of frame 20 may include a supporting structure such as a solid board without arms shaped as, for example, a hexagon or circular with an aperture to receive the base of the tree. In yet another embodiment, the board is coupled to connecting arms 20A–20H to provide additional support to connecting arms 20A–20H.

Figure 3:
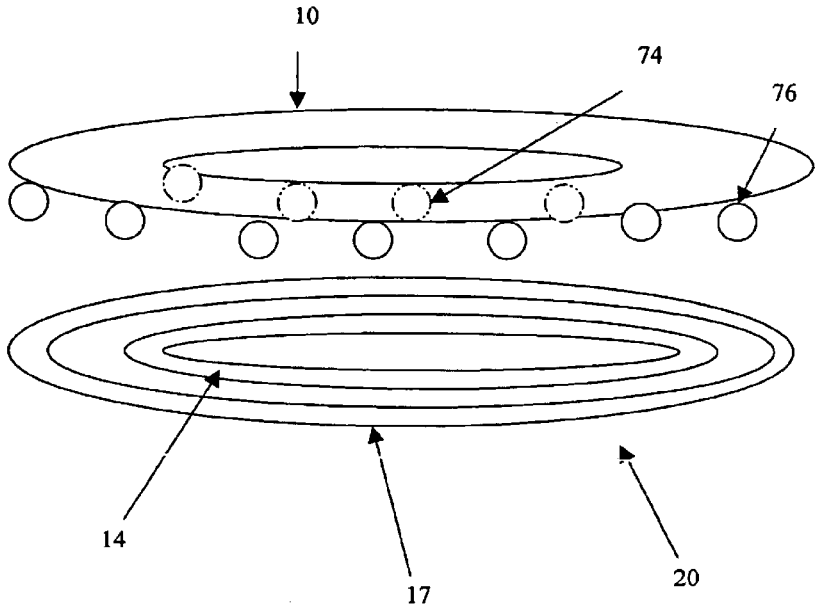
FIG. 3 is a block diagram of one embodiment of an apparatus for rotating objects around a tree.

FIG. 3 is a block diagram of one embodiment of an apparatus for rotating objects around a tree. In this embodiment, first and second set of wheels (74, 76) are coupled to rigid material 10 and contact first and second grooves (14, 17) disposed in frame 20. This embodiment shows another way in which rigid material 10 may be rotated around a tree by allowing first and second set of wheels (74, 76) rotate about first and second set of grooves (14, 17) disposed in frame 20.

Figure 4A:
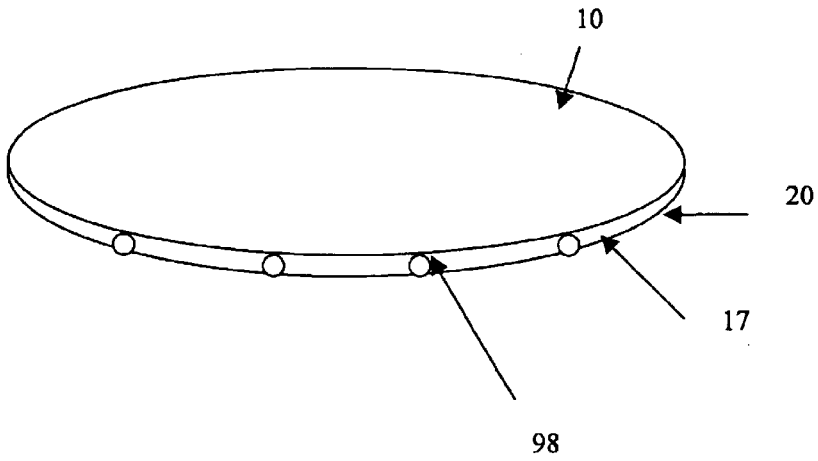
FIG. 4A is a block diagram of one embodiment of an apparatus for rotating objects around a tree.
Figure 4B:
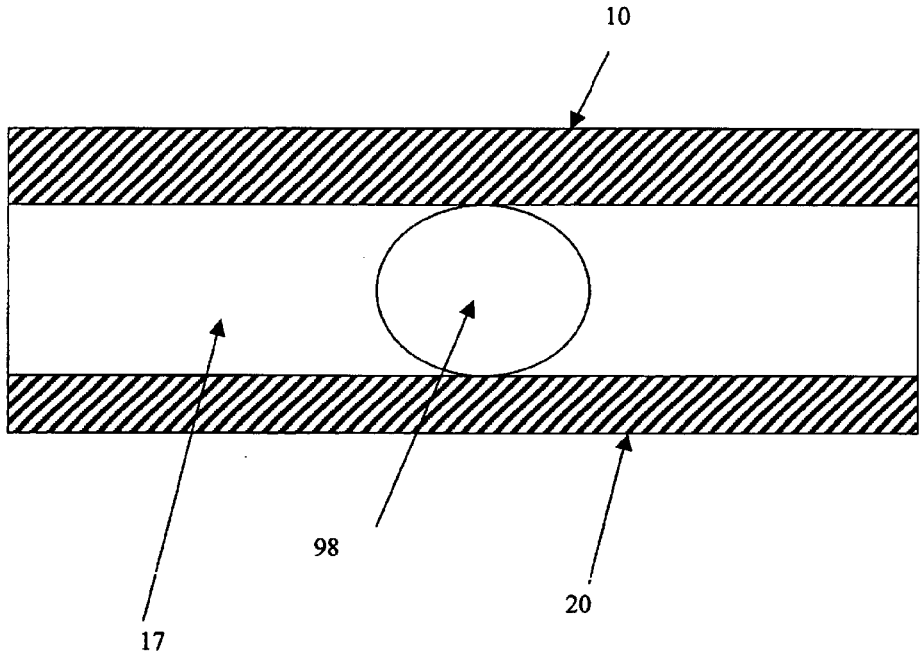
FIG. 4B is a cross-sectional view of one embodiment of spherical objects in grooves for rotating objects around a tree.

FIG. 4A is a block diagram of one embodiment of an apparatus for rotating objects around a tree. In this embodiment, spherical objects 98 similar to marbles may be placed between first and second grooves (14, 17) disposed in rigid material 10 and frame 29. FIG. 4B is a cross-sectional view of spherical objects 98 adapted to rotate between first and second grooves (14, 17) disposed in frame 20 and rigid material 10.

Figure 5:
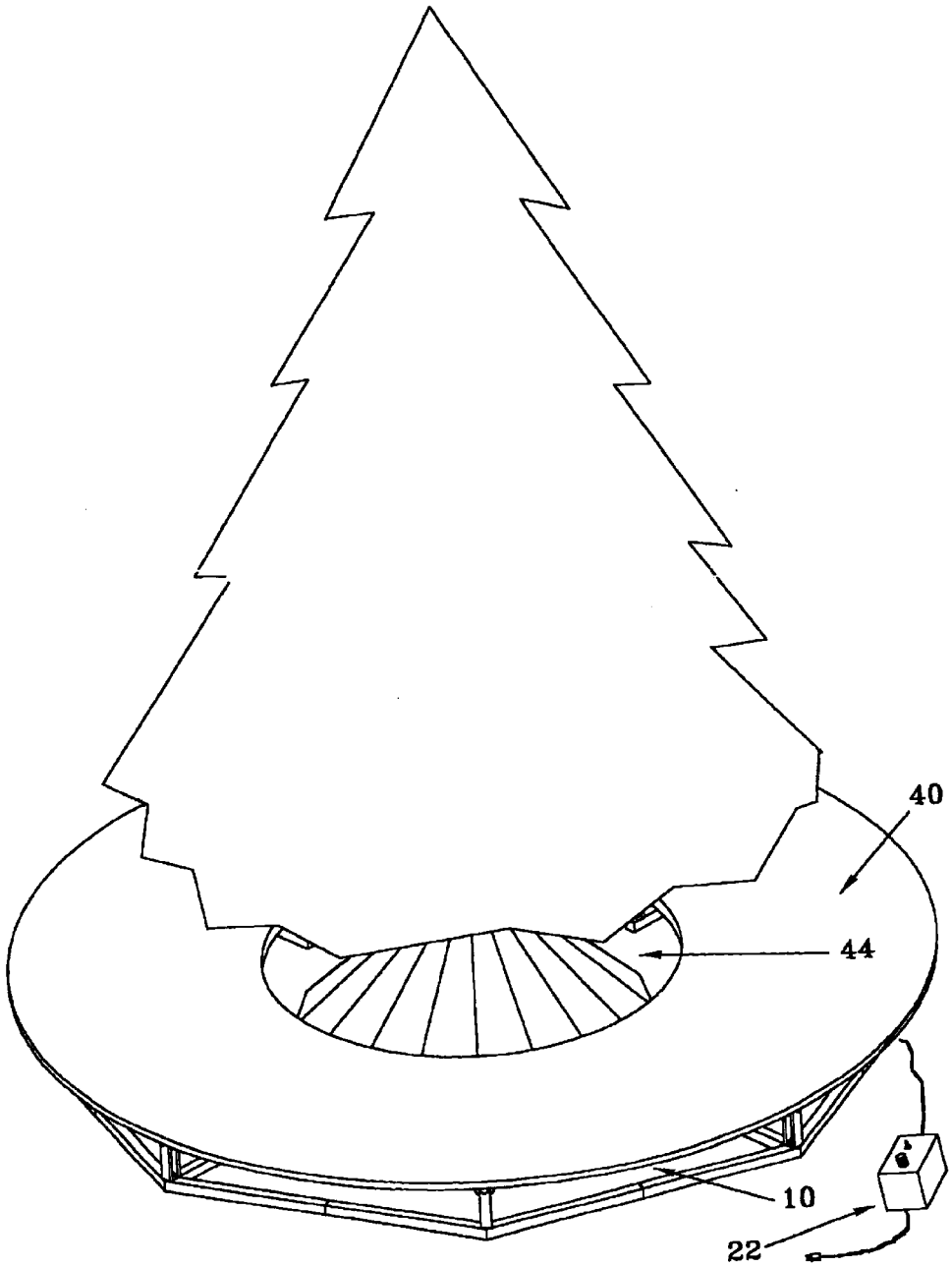
FIG. 5 is a block diagram of one embodiment of an apparatus for rotating objects around a tree.

FIG. 5 is a block diagram of one embodiment of an apparatus for rotating objects around a tree. In this embodiment, the tree is shown to extend through first and second apertures (44, 54) of rigid material 10 and frame 20. Frame 20 is also shown to have a smaller diameter than rigid material 10. This allows the objects or gifts to be more easily accessed by a person.

Given the description of the manner in which rigid material 10 and frame 20 interrelate, it will be appreciated that rigid material 10 and frame 20 may comprise a variety of materials such as wood, plywood, plastic, metallic material, or other suitable material. Rigid material 10 and frame 20 may also have a variety of shapes such as substantially circular, triangular, square, hexagon or any other suitable shapes.

Figure 6:
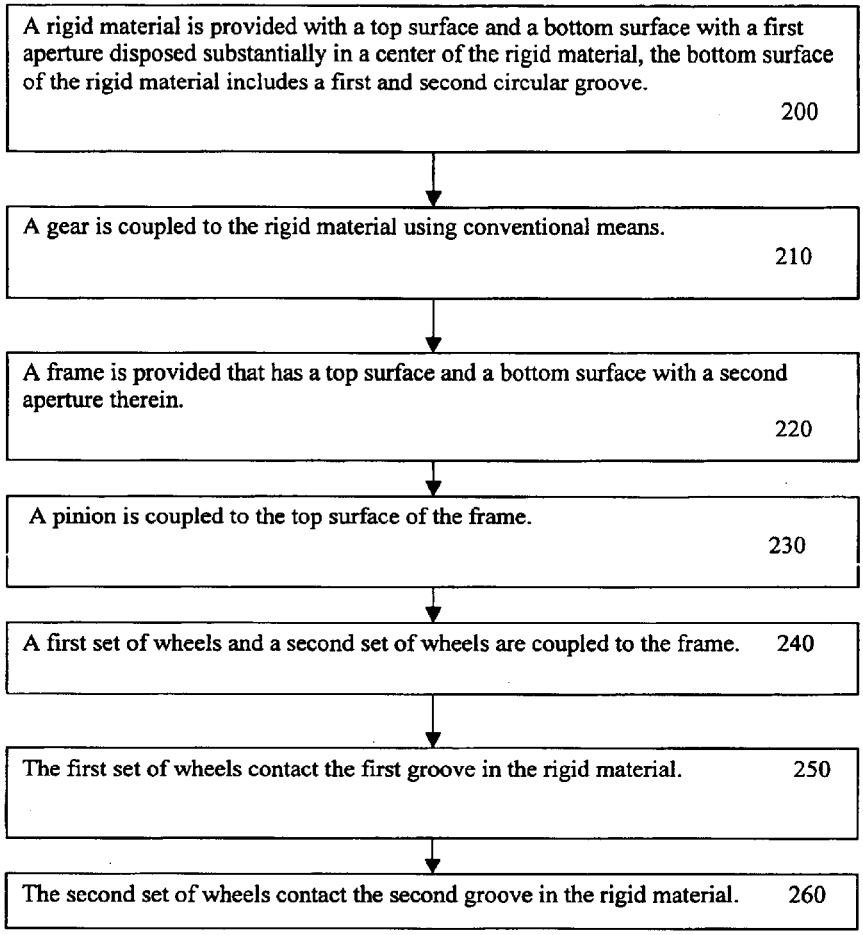
FIG. 6 is a flow diagram of one method for manufacturing an apparatus for rotating objects around a tree.

FIG. 6 illustrates a flow diagram of one method of forming an apparatus for rotating objects around a base of a tree. At block 200, a rigid material is provided with a top surface and a bottom surface with a first aperture disposed substantially in a center of the rigid material, the bottom surface of the rigid material includes a first and second circular groove. At block 210, a gear is coupled to the rigid material using conventional means. At block 220, a frame is provided that has a top surface and a bottom surface with a second aperture therein. At block 230, a pinion is coupled to the top surface of the frame. The pinion is configured to rotate about the gear of the rigid material. At block 240, a first set of wheels and a second set of wheels are coupled to the frame. In one embodiment, the first and second set of wheels are coupled to the top surface of the frame facing the bottom surface of the rigid material. At block 250, the first set of wheels contact the first groove in the rigid material. At block 260, the second set of wheels contact the second groove in the rigid material.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

It will be further appreciated that more or fewer processes may be incorporated into the method illustrated in FIG. 5 without departing from the scope of the invention and that no particular order is implied by the arrangement of blocks shown and described herein.

What is claimed is:

1. A method of making a device for rotating objects around a Christmas tree, the method comprising:

providing a rigid material with a top surface and a bottom surface and a first aperture disposed substantially in a center of the rigid material, the bottom surface of the rigid material includes a first and second circular groove;

coupling a gear to the rigid material;

providing a frame that has a top surface and a bottom surface with a second aperture therein, coupling a pinion to the top surface of the frame, the pinion is configured to rotate about the gear of the rigid material;

coupling a first set of wheels and a second set of wheels to the top surface of the frame;

contacting the first set of wheels with the first groove;

contacting the second set of wheels with the second groove; and aligning the rigid material and the frame to allow a base of a tree to extend through the first aperture of the rigid material and the second aperture of the frame.

2. The method of claim 1, wherein the rigid material is circular.

3. The method of claim 1, the rigid material comprises a material selected from a group consisting of wood and plastic.

* * * * *